US008523171B2

(12) United States Patent
Fujita et al.

(10) Patent No.: US 8,523,171 B2
(45) Date of Patent: Sep. 3, 2013

(54) PAPER FEEDER AND IMAGE FORMING APPARATUS INCLUDING THE SAME

(75) Inventors: Masahiko Fujita, Osaka (JP); Masaharu Kimura, Osaka (JP); Yasuaki Fukada, Osaka (JP); Susumu Hashimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/472,678

(22) Filed: May 16, 2012

(65) Prior Publication Data

US 2012/0299236 A1 Nov. 29, 2012

(30) Foreign Application Priority Data

May 24, 2011 (JP) ..... 2011-115890

(51) Int. Cl.
*B65H 3/12* (2006.01)

(52) U.S. Cl.
USPC ..... 271/96; 271/90; 271/94; 271/97; 271/98; 271/108

(58) Field of Classification Search
USPC ..... 271/90, 94, 96–98, 108
See application file for complete search history.

(56) References Cited

U.S. PATENT DOCUMENTS

| | | | | |
|---|---|---|---|---|
| 6,186,491 | B1 * | 2/2001 | Tomiyama et al. | 271/12 |
| 7,461,839 | B2 * | 12/2008 | Ikeda | 271/108 |
| 8,210,519 | B2 * | 7/2012 | Fukusaka et al. | 271/98 |
| 2008/0237968 | A1 | 10/2008 | Suzuki | |
| 2010/0187747 | A1 * | 7/2010 | Kannari et al. | 271/3.16 |
| 2011/0233848 | A1 * | 9/2011 | Kostudis et al. | 271/12 |

FOREIGN PATENT DOCUMENTS

| | | |
|---|---|---|
| JP | 07-157122 | 6/1965 |
| JP | 62-17649 U | 2/1987 |
| JP | 06-001467 | 1/1994 |
| JP | 2008-239312 | 10/2008 |

* cited by examiner

*Primary Examiner* — Prasad Gokhale
(74) *Attorney, Agent, or Firm* — Renner, Otto, Boisselle & Sklar, LLP

(57) ABSTRACT

In a paper feeder, an air hole that allows air to pass through is formed on a paper transport belt, a fan for breathing and exhausting air and an exhaust duct having an opening for exhausting air. Air is exhausted from the fan through the exhaust duct, the fan and an air intake duct for breathing air are connected to each other, and air is breathed from the air hole through the air intake duct towards the fan. This paper feeder includes: an air state detection unit for detecting at least one of an air pressure and an air flow rate in the air intake duct; an opening and closing unit provided to the air intake duct for opening and closing the opening; and a control unit for opening and closing the opening based on a result of detection by the air state detection unit.

9 Claims, 14 Drawing Sheets

PAPER FEEDER AND IMAGE FORMING APPARATUS INCLUDING THE SAME

BACKGROUND OF THE INVENTION

This application claims priority under 35 U.S.C. §119(a) on Patent Application No. 2011-115890 filed in Japan on May 24, 2011, the entire contents of which are herein incorporated by reference.

BACKGROUND OF THE INVENTION

1. Field of the Invention

The present invention relates to a paper feeder for pulling out and sending papers from a bundle of papers loaded on a paper tray, and an image forming apparatus including this paper feeder.

2. Description of the Related Art

An example of this kind of paper feeders is disclosed in JP H6-1467 (hereinafter referred to as Patent Literature 1). Here, a paper transport belt is arranged above the paper tray, air is breathed from an air hole on the paper transport belt through an air intake duct towards a fan, and papers in a bundle of papers on the paper tray is attached to the paper transport belt and thus transported. The air exhausted by the same fan is blown through an exhaust duct against the sides of the bundle of papers on the paper tray, thus the air is caused to flow into the respective papers in the bundle of papers to reduce the adhesion between the papers, thereby facilitating pulling out of each paper. Both the air breathed and the air exhausted by a single fan are used to save the number of parts.

Further, a valve is provided to the air intake duct, and an air path in the air intake duct is narrowed by this valve, thereby adjusting the amount of air that flows in the air path in the air intake duct.

Incidentally, with the configuration where a single fan breaths air from the air hole on the paper transport belt through the air intake duct and causes air to blow through the exhaust duct against the sides of a bundle of papers on the paper tray, the amounts of air breathed by the fan and that exhausted by the fan are approximately the same, and one of the amounts of air decreases as the other decreases. Therefore, when a sheet of paper is attached to the paper transport belt and blocks the air hole on the paper transport belt and the amount of the breathed air decreases, the amount of the air blown against the sides of the bundle of papers on the paper tray accordingly decreases, the air is not caused to flow into the papers, the adhesion between the papers is not reduced, and a transportation error where a plurality of papers are simultaneously pulled out occurs in some cases.

Also in Patent Literature 1, the amount of air that flows in the air path in the air intake duct is adjusted by narrowing the air path in the air intake duct with the valve. However, if the air hole on the paper transport belt is blocked and the amount of the air breathed towards the air intake duct reduces, the amount of air is not increased even if the valve is opened.

The present invention was made in light of the foregoing conventional problems, and it is an object thereof to provide a paper feeder in which it is assumed a configuration where papers are attached to the paper transport belt and air is blown against the sides of a bundle of papers using the air breathed and exhausted with a single fan, and even if a sheet of paper is attached to the paper transport belt, the amount of air blown against the sides of the bundle of papers does not reduce, and an image forming apparatus including this paper feeder.

SUMMARY OF THE INVENTION

To solve the foregoing problems, in a paper feeder of the present invention, an air hole that allows air to pass through is formed on a paper transport belt for transporting a sheet of paper, a fan for breathing and exhausting air and an exhaust duct forming an opening for exhausting air are connected to each other, air is exhausted from the fan through the exhaust duct, the fan and an air intake duct for breathing air are connected to each other, air is breathed from the air hole through the air intake duct towards the fan, and a sheet of paper is transported by the paper transport belt by causing the paper to be attached to the paper transport belt. This paper feeder includes: an air state detection unit for detecting at least one of an air pressure and an air flow rate in the air intake duct; an opening and closing unit provided to the air intake duct for opening and closing the opening; and a control unit for opening and closing the opening based on a result of detection by the air state detection unit.

Incidentally, in a paper feeder, in some cases the air hole on the paper transport belt is blocked when a sheet of paper is attached to the paper transport belt, and the amount of breathed air reduces. At this time, the amount of air exhausted through the exhaust duct also reduces, and the exhausted air cannot be utilized. For example, in the case where exhausted air is blown through the exhaust duct against the respective papers to reduce the adhesion between the papers, the adhesion between the papers is not reduced, and a transportation error of simultaneously drawing a plurality of papers occurs.

Therefore, in the present invention, considering the fact that if the amount of breathed air reduces, the air pressure and the air flow rate in the air intake duct varies, at least one of the air pressure and the air flow rate is detected, and the opening and closing unit is opened or closed based on the detection result. In other words, the opening and closing unit is controlled to open or close the opening in the air intake duct based on the detection result. Thus, if the amount of breathed air reduces, air can be caused to flow from the opening into the air intake duct, the amount of air breathed and exhausted from the fan is increased and restored, the air is blown between the papers, and the transportation error of simultaneously drawing a plurality of papers is prevented.

In the paper feeder of the present invention, if either one of the air pressure and the air flow rate in the air intake duct detected by the air state detection unit becomes lower than a predetermined threshold, the control unit controls the opening and closing unit to open the opening, and if either one of the air pressure and the air flow rate in the air intake duct becomes equal to or higher than the predetermined threshold, the control unit controls the opening and closing unit to close the opening.

The threshold compared with the air pressure or the air flow rate in the air intake duct may be predetermined, and the opening may be opened if the air pressure or the air flow rate in the air intake duct becomes less than the threshold. Thus, if the amount of breathed air reduces, air can be caused to flow from the opening into the air intake duct. Further, the opening is closed after the air pressure or the air flow rate in the air intake duct becomes the threshold or higher, that is, after the air pressure or the air flow rate in the air intake duct is increased and restored. Therefore, the air suction force from the air hole on the paper transport belt is hardly reduced, and it is possible to suppress reduction of the attachment force of papers to the paper transport belt and keep the state where each paper is attached to the paper transport belt.

Further, in the paper feeder of the present invention, if either one of the air pressure and the air flow rate in the air intake duct detected by the air state detection unit becomes lower than a predetermined threshold, the control unit controls the opening and closing unit to open the opening, and when a predetermined time elapses from at time the opening is opened, the control unit controls the opening and closing unit to close the opening.

The opening may be opened if the air pressure or the air flow rate in the air intake duct becomes lower than a predetermined threshold. Thus, if the amount of breathed air reduces, air can be caused to flow from the opening into the air intake duct. Further, by closing the opening after a lapse of a predetermined time after the opening is opened, the air suction force from air hole on the paper transport belt is hardly reduced, and it is possible to suppress reduction of the attaching force of papers to the paper transport belt and keep the state where each paper is attached to the paper transport belt.

Further, in the paper feeder of the present invention, when the control unit controls the opening and closing unit to open the opening, the control unit controls the fan to accelerate a rotational speed of the fan.

In this case, when the opening is opened, air is caused to flow from the opening into the air intake duct, and the amount of air exhausted from the fan is increased and restored. By accelerating the rotational speed of the fan at this time, the amount of air exhausted by the fan can be more promptly restored.

Further, in the paper feeder of the present invention, the air state detection unit may be provided near the opening in the air intake duct.

Thus, variation in the air pressure or the air flow rate caused by opening the opening can be detected with accuracy.

In the paper feeder of the present invention, the air state detection unit may be provided downstream of the opening in the air intake duct in a direction of air flow in the air intake duct.

In this case, if the opening is opened, air is caused to flow from the opening through the air intake duct towards the fan. Therefore, by providing the air state detection unit downstream of the opening in a direction of air flow, the variation in the air pressure or the air flow rate can be detected most promptly.

The image forming apparatus of the present invention includes the above-described paper feeder of the present invention. Such an image forming apparatus of the present invention also has the same effect as that of the above-described paper feeder of the present invention.

BRIEF DESCRIPTION OF THE DRAWINGS

FIGS. 7A and 7B are simplified side view and plan view of a height position sensor for detecting the height of a bundle of papers loaded on the paper tray, respectively. FIG. 7C is a side view showing an operating state of the height position sensor.

FIG. 13 includes FIGS. 13A and 13B.

DESCRIPTION OF REFERENCE NUMERALS

Figure 1:
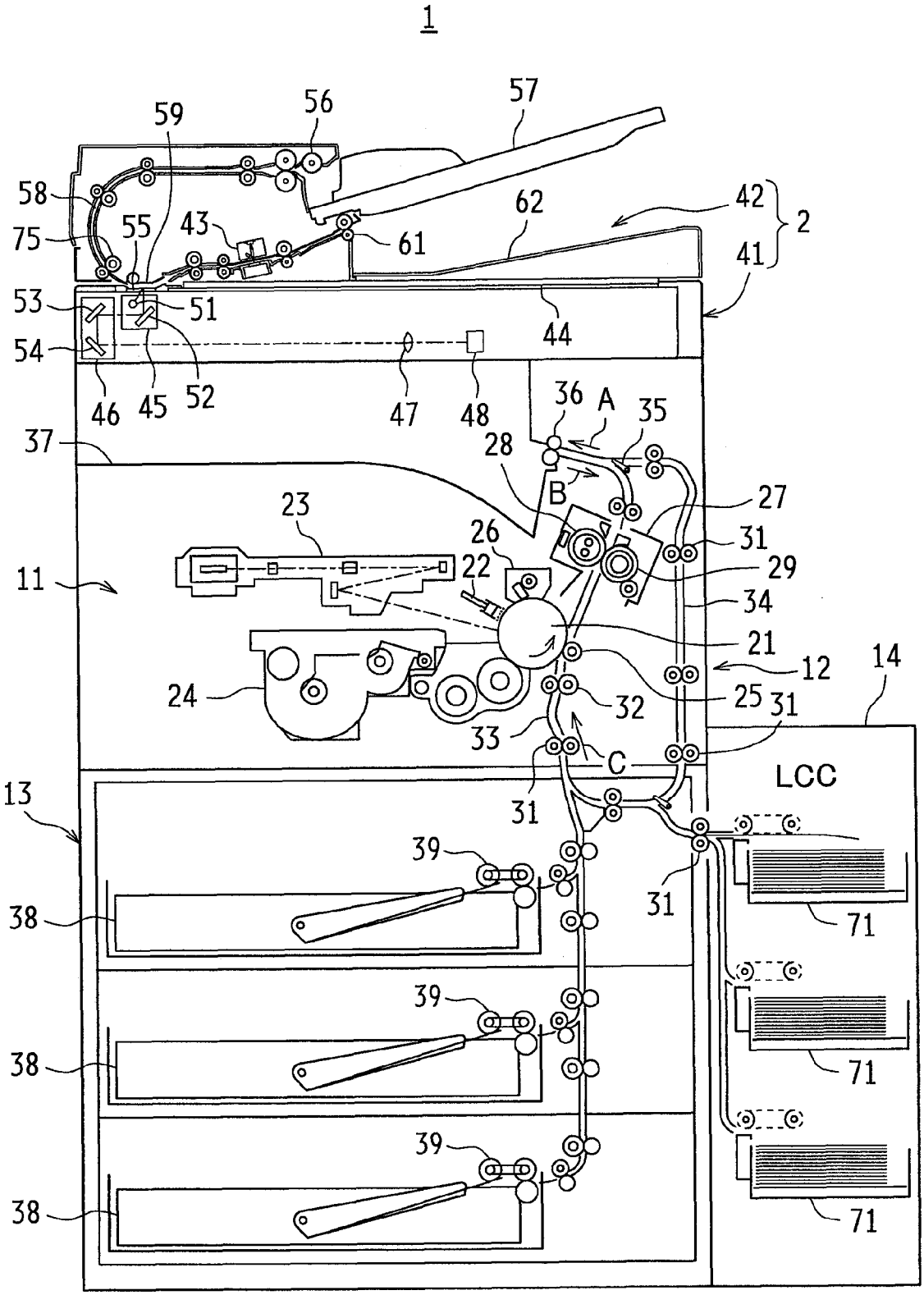
FIG. 1 is a cross-sectional view of an image forming apparatus to which one embodiment of a paper feeder of the present invention is applied.

1 Image forming apparatus
2 Original reader
11 Printing unit
12 Paper transport unit
13 Paper supply unit
14 Large capacity cassette (LCC)
71 Paper feeder
72 Outer frame body
73 Bottom plate
74 Paper tray
75 Paper pull-out unit
76 Paper trailing edge guide
77, 78 Assist duct
79, 80 Assist fan
81 Paper transport belt
82, 83 Roller
84 Air intake and exhaust fan (fan)
85 Air intake duct
85*k* Opening
86 Exhaust duct
92 Pulse motor
93 Height position sensor
101 Opening and closing body (opening and closing unit)
102 Air pressure sensor (air state detection unit)
106 Solenoid
107 Transport motor
111 Control unit

DESCRIPTION OF THE PREFERRED EMBODIMENT

An embodiment of the present invention will be hereinafter described in detail with reference to the accompanying drawings.

FIG. 1 is a cross-sectional view of an image forming apparatus to which one embodiment of a paper feeder of the present invention is applied. This image forming apparatus 1 is designed to print a monochrome image represented by image data on a recording paper, and its configuration is roughly divided into an original reader 2, a printing unit 11, a paper transport unit 12, a paper supply unit 13, and a large capacity cassette (LCC) 14.

This image forming apparatus 1 generates image data by reading an original image with the original reader 2, or acquires image data by receiving image data input from an external terminal apparatus or the like, performs various types of image processing on the image data, and then prints the image represented by the image data on a recording paper with the printing unit 11.

A photosensitive drum 21 is arranged at the approximate center of the printing unit 11, and a charging device 22, a laser exposure device 23, a development device 24, a transfer roller 25, and a cleaning device 26 are arranged around the photosensitive drum 21.

A fixing device 27 is provided in the upper part of the printing unit 11. The fixing device 27 has a heating roller 28 and a pressing roller 29 that are pressed against each other, heats and presses a recording paper held at a nip area between the heating roller 28 and the pressing roller 29, and fixes a toner image transferred onto the recording paper. This recording paper is transported from the fixing device 27 to a discharge roller pair 36, and discharged to a discharge tray 37 by the discharge roller pair 36.

The paper supply unit 13 has a plurality of paper feed cassettes 38. The paper feed cassettes 38 are trays for containing recording papers and provided on a plurality of stages in the lower part of the image forming apparatus 1. Each paper feed cassette 38 is provided with a pickup roller 39 and the like for pulling out and sending recording papers one by one, and a pulled-out recording paper is sent out to a transport path 33 in the paper transport unit 12.

The large capacity cassette (LCC) 14 is capable of containing a large amount of recording papers, and pulls out and sends recording papers one by one to the transport path 33 in the paper transport unit 12 in a similar manner to the paper feed cassettes 38.

The paper transport unit 12 includes a plurality of transport roller pairs 31 for transporting recording papers, a registration roller pair 32, a transport path 33, an alternative path 34, a branch claw 35, a discharge roller pair 36, a discharge tray 37, and the like. In this transport path 33, a recording paper pulled out from any of the paper feed cassettes is transported in a paper transport direction C and delivered to the registration roller pair 32. The leading end of the recording paper is caused to abut against the registration roller pair 32 that is temporarily stopped and thus bent such that the leading end of the recording paper is aligned parallel to the registration roller pair 32 due to the elastic force of the recording paper. Then, the registration roller pair 32 starts to rotate and transports the recording paper to the nip area between the photosensitive drum 21 and the transfer roller 25. This recording paper passes through the nip area between the photosensitive drum 21 and the transfer roller 25, and the toner image is transferred onto the recording paper. It then passes through the nip area between the heating roller 28 and the pressing roller 29, and the toner image is fixed on the recording paper. It is then transported by the discharge roller pair 36 in the forward direction A and discharged to the discharge tray 37.

Further, if an image is also printed on the back face of the recording paper, the discharge roller pair 36 is stopped while the recording paper is being transported in the forward direction A and discharged to the discharge tray 37. In other words, the discharge roller pair 36 is stopped in a state where the recording paper is held between the rollers. The branch claw 35 is shifted obliquely downward, and the discharge roller pair 36 is then rotated in a reverse direction to transport the recording paper in a reverse direction B and leads it to the alternative path 34, and then the recording paper is again led to the transport path 33 through the alternative path 34 and returned to the registration roller pair 32.

Such shifting of the transport direction of recording papers is referred to as "switch-back transport," with which a recording paper is turned over and simultaneously its leading end and back end are switched. Accordingly, when the turned recording paper is returned, the back end of the recording paper is caused to abut against the registration roller pair 32 and aligned parallel to the registration roller pair 32. The recording paper is transported from its back end by the registration roller pair 32 to the nip area between the photosensitive drum 21 and the transfer roller 25, the image is printed on the back face of the recording paper, the toner image is fixed on the back face of the recording paper by the heating roller 28 and the pressing roller 29, and the recording paper is discharged to the discharge tray 37 through the discharge roller pair 36.

Next, a configuration of the paper feeder built in the large capacity cassette 14 in the present embodiment is described in detail. This paper feeder is designed to contain a large amount of recording papers and pull out and send the recording papers one by one to the transport path 33 (shown in FIG. 1).

Figure 2:
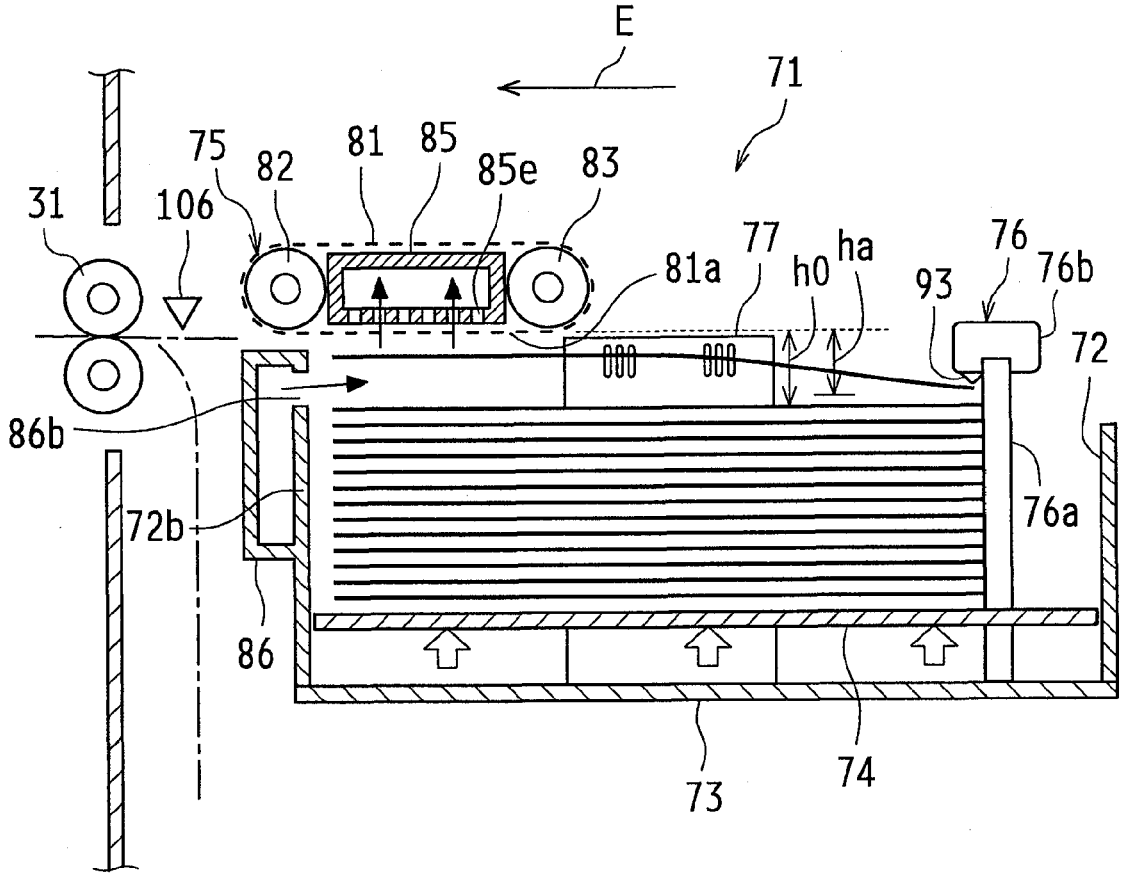
FIG. 2 is a schematic side view of the paper feeder in the present embodiment.

FIG. 2 is a schematic side view of the paper feeder in the present embodiment. As shown in FIG. 2, the paper feeder 71 includes an outer frame body 72, a bottom plate 73, a paper tray 74 arranged inside the outer frame body 72, a paper pull-out unit 75 arranged at one end on the upper side of the outer frame body 72, and the like.

The paper tray 74 is designed to be loaded with a large amount of recording papers (a bundle of papers), and is provided to be capable of moving up and down inside the outer frame body 72.

The paper pull-out unit 75 has a paper transport belt 81 for transporting papers, a pair of rollers 82 and 83 for stretching the paper transport belt 81, an air intake and exhaust fan (not shown) for taking in and exhausting air, an air intake duct 85 for taking in air, an exhaust duct 86 for taking out air, and the like. The paper transport belt 81 is provided with a number of air holes 81*a* for letting air pass through. Air is breathed from the air holes 81*a* on the paper transport belt 81 through the air intake duct 85 towards the air intake and exhaust fan, and a recording paper in a bundle of papers on the paper tray 74 is attached to the lower surface of the paper transport belt 81. The paper transport belt 81 is intermittently revolving, and pulls out, in a pull-out direction E, the recording paper attached to the lower surface thereof and transports the recording paper to the transport roller pair 31. This recording paper is transported to the registration roller pair 32 through the transport path 33 shown in FIG. 1.

The air exhausted from the air intake and exhaust fan is led through the exhaust duct 86, and blown from an exhaust port 86*b* in the exhaust duct 86 against the upper layer of the leading end side of the bundle of papers on the paper tray 74 and flow into the respective recording papers to separate them. Thus, the adhesion between the respective recording papers in the upper layer of the bundle of papers is lowered, and it becomes easier to pull out recording papers from the bundle of papers and to pull out those papers one by one.

Accordingly, with a single air intake and exhaust fan, air is breathed from the air holes 81*a* on the paper transport belt 81 through the air intake duct 85 and blown through the exhaust duct 86 against the side of the bundle of papers on the paper tray 74.

Figure 3:
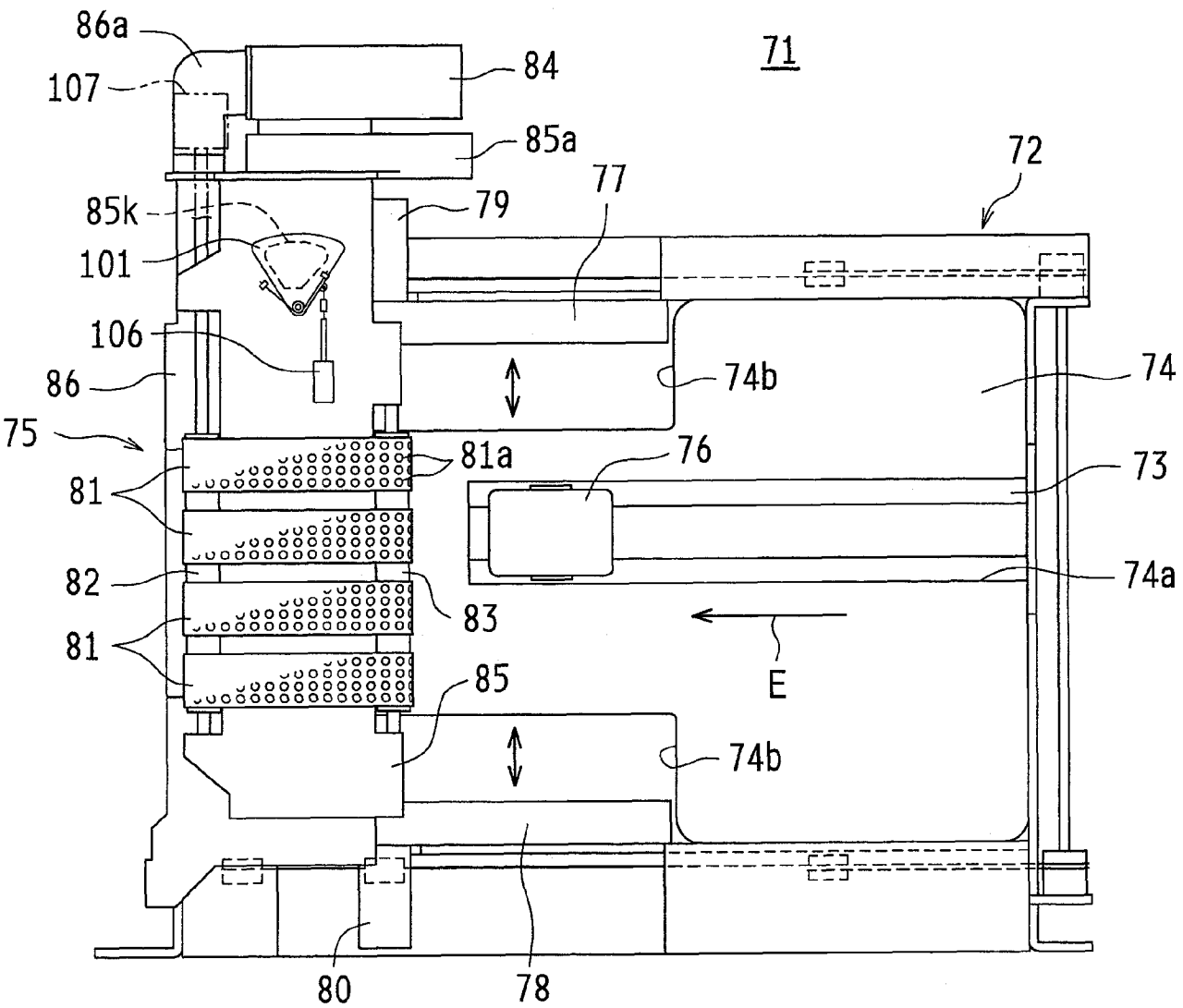
FIG. 3 is a plan view of the paper feeder shown in FIG. 2.
Figure 4:
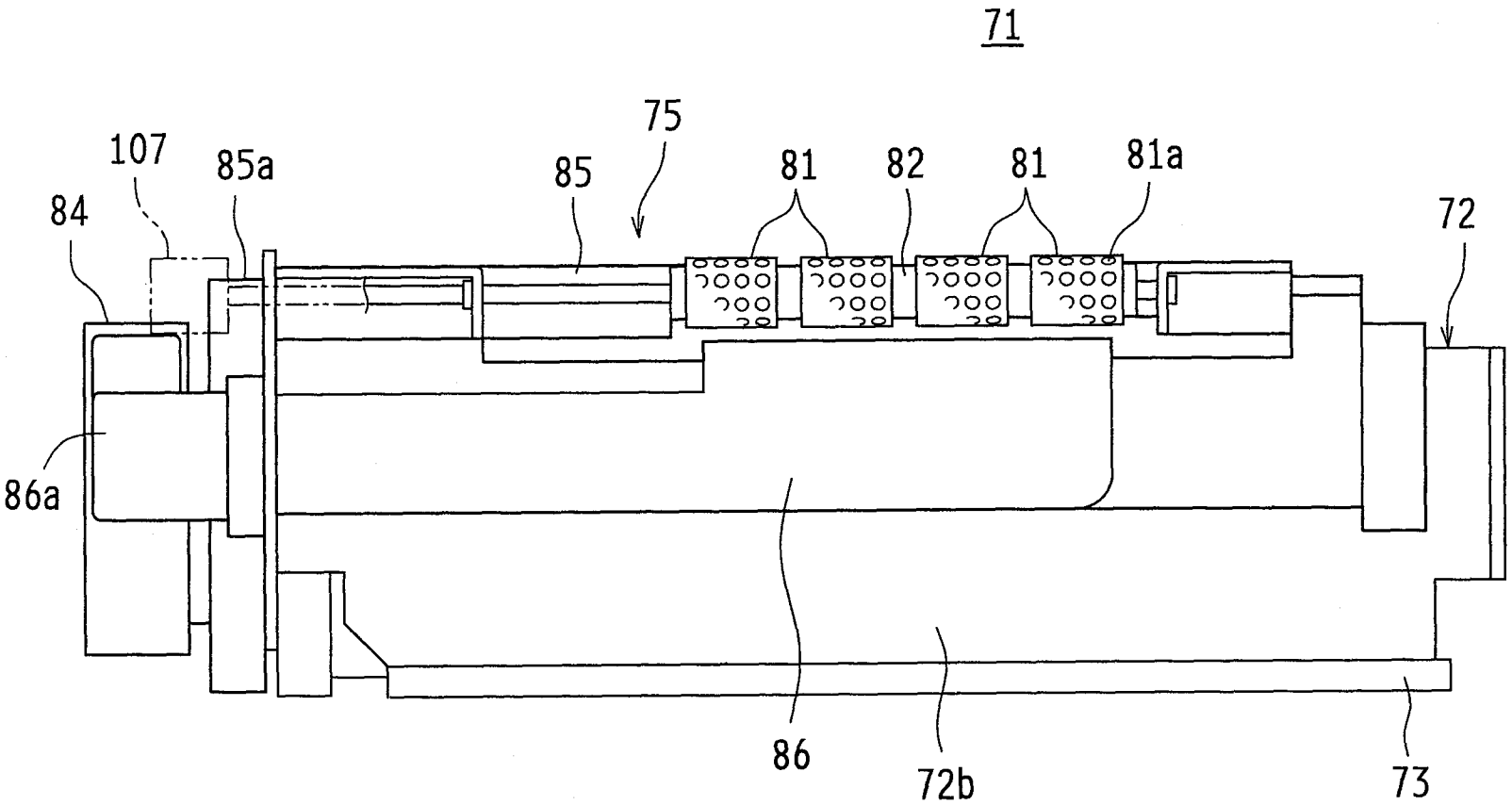
FIG. 4 is a front view of the paper feeder shown in FIG. 2.

FIGS. 3 and 4 are a plan view and a front view of the paper feeder in the present embodiment. As shown in FIGS. 3 and 4, the paper tray 74 is provided with a long hole 74*a* that extends in a recording paper pull-out direction (paper feeding and transporting direction) E. A paper trailing edge guide 76 is supported on the bottom plate 73 reciprocatably along the recording paper pull-out direction E, and protrudes upward through the long hole 74*a* in the paper tray 74. Note that the "front" indicates the recording paper pull-out direction E, and the "back" indicates the opposite direction of the pull-out direction E.

Both sides of the paper tray 74 are respectively provided with recesses 74*b*, where assist ducts 77 and 78 are arranged respectively. Each of the assist ducts 77 and 78 is supported reciprocatably in a direction orthogonal to the pull-out direction E on both sides of the outer frame body 72, and is moved in conjunction with each other to come close to or away from each other.

The paper pull-out unit 75 includes four paper transport belts 81, a pair of rollers 82 and 83 for stretching the paper transport belts 81, an air intake and exhaust fan 84, an air intake duct 85, an exhaust duct 86, and the like. Each paper transport belt 81 is provided with a number of air holes 81*a*, and air is breathed from the air holes 81*a* on the paper transport belts 81 through air intake duct 85 towards the air intake and exhaust fan 84. The air exhausted from the air intake and exhaust fan 84 is led through the exhaust duct 86 and blown in the direction opposite the pull-out direction E (backward) from the exhaust duct 86 towards the inside of the outer frame body 72.

Figure 5:
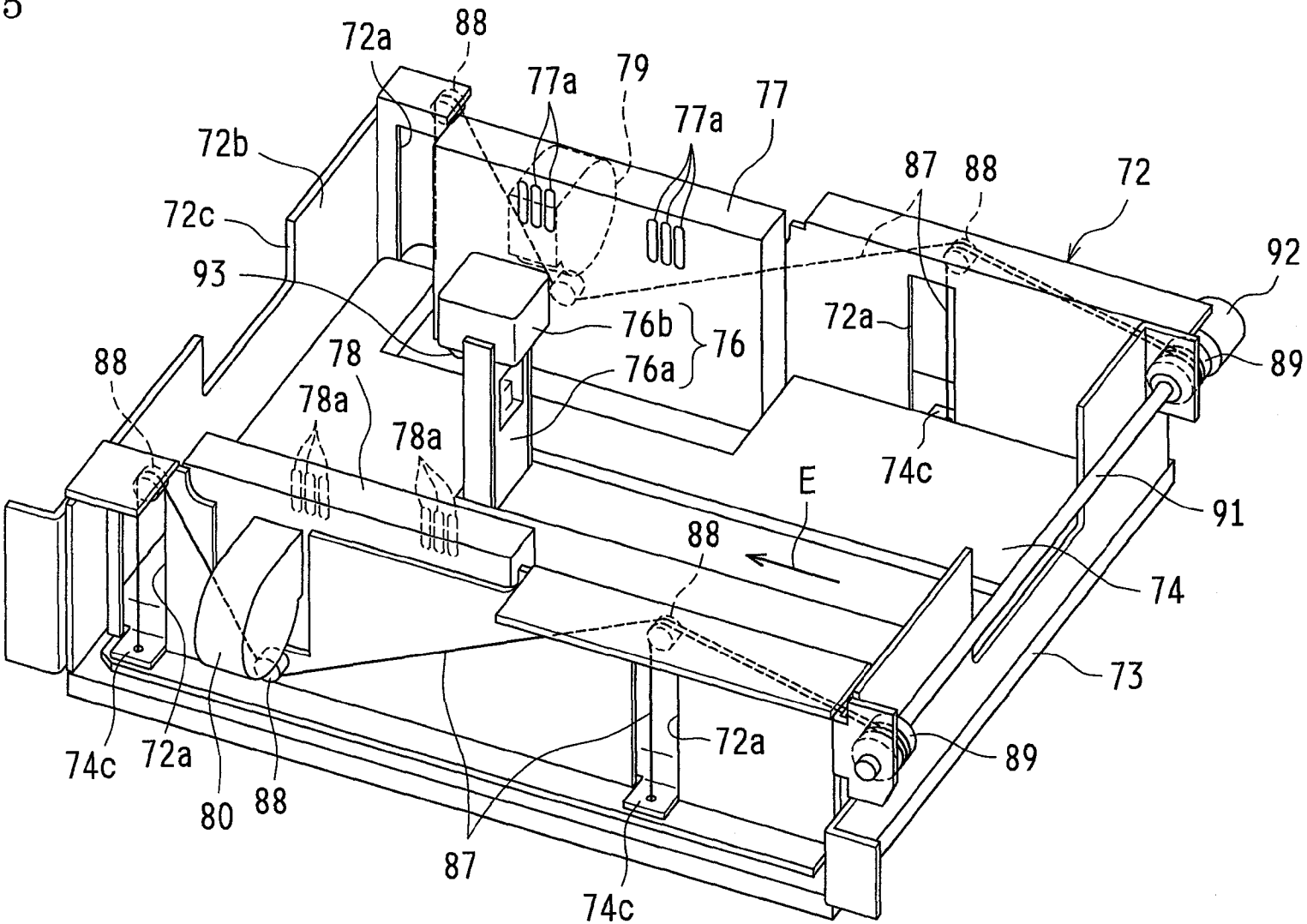
FIG. 5 is an oblique view of the paper feeder in a state where a paper pull-out unit is detached, viewed diagonally from the back.

FIG. 5 is an oblique view of the outer frame body 72, the bottom plate 73, the paper tray 74, and the like viewed from the diagonal back in a state where the paper pull-out unit 75 is detached. As shown in FIG. 5, assist fans 79 and 80 are provided outside the assist ducts 77 and 78, respectively. Each of the assist ducts 77 and 78 is a hollow body and has an air path inside, and the air breathed by the assist fans 79 and 80 is sent to the air paths in the assist ducts 77 and 78 and blown towards the inside of the outer frame body 72 from exhaust ports 77*a* and 78*a* respectively in the assist ducts 77 and 78.

Further, as shown in FIGS. 3 and 5, the paper trailing edge guide 76 can reciprocate along the recording paper pull-out direction E, and is positioned at an arbitrary location along the pull-out direction E. Furthermore, as shown in FIGS. 3 and 5, the assist ducts 77 and 78 can reciprocate in the direction orthogonal to the pull-out direction E and are positioned at an arbitrary location along the direction orthogonal to the pull-out direction E.

Here, when a bundle of papers is loaded on the paper tray 74, the paper trailing edge guide 76 is moved backward such that the space between a column 76*a* in the paper trailing edge guide 76 and an attachment plate 72*b* in the outer frame body 72 is opened wide, and the assist ducts 77 and 78 are moved in the directions opposite to each other such that the space between the assist ducts 77 and 78 is opened wide. In this state, a bundle of papers is loaded on the paper tray 74, then the paper trailing edge guide 76 is moved in the pull-out direction E, the back end of the bundle of papers is pressed by the column 76*a* in the paper trailing edge guide 76 in the pull-out direction E, thereby causing the bundle of papers to slip and move on the paper tray 74, the leading end of the bundle of papers is caused to abut against the attachment plate 72*b* in the outer frame body 72, and the bundle of papers is positioned by holding the leading end and the back end thereof between the column 76*a* in the paper trailing edge guide 76 and the attachment plate 72*b* in the outer frame body 72. Further, the assist ducts 77 and 78 are moved to close to each other, and the bundle of papers is positioned by holding the both ends thereof between the assist ducts 77 and 78.

Further, as shown in FIG. 5, both sides of the paper tray 74 are provided with two protruding pieces 74*c*, and these protruding pieces 74*c* protrude from rectangular holes 72*a* on both sides of the outer frame body 72. On one side of the outer frame body 72, two wires 87 are connected to the respective protruding pieces 74*c* on one side of the paper tray 74, and each wire 87 is caught and extended around a plurality of idler pulleys 88 and connected to the take-up pulley 89. Also on the other side of the outer frame body 72, other two wires 87 are connected to the respective protruding pieces 74*c* on the other side of the paper tray 74, and each wire 87 is caught and extended around a plurality of other idler pulleys 88 and connected to another take-up pulley 89. Each take-up pulley 89 is secured to both ends of a rotatably supported common shaft 91. Rotation of the shaft 91 is driven by a pulse motor 92, thereby rotating the take-up pulleys 89, and the wires 87 are reeled by the take-up pulleys 89 or unreeled from the take-up pulleys 89.

Figure 6:
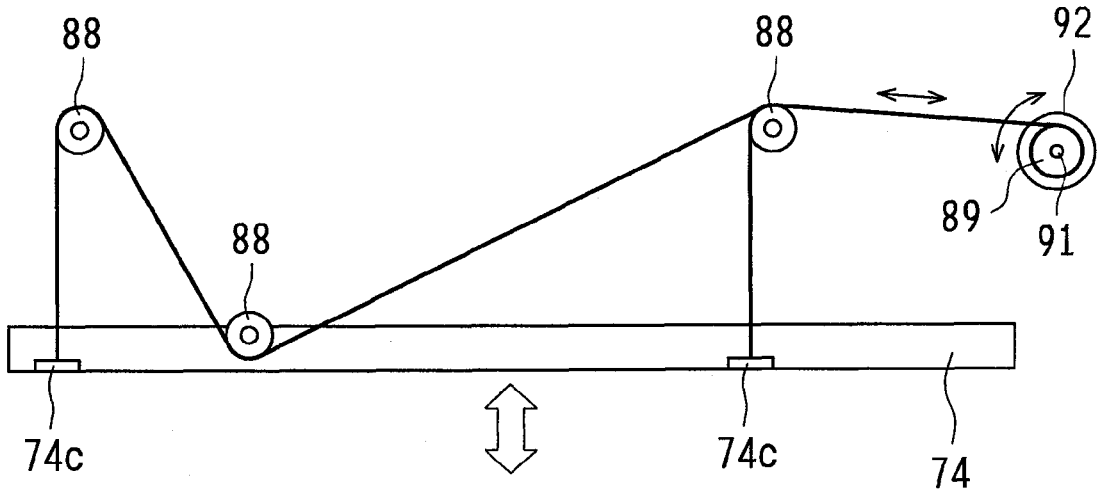
FIG. 6 is a simplified side view of a paper tray, a wire, an idler pulley, and a take-up pulley in the paper feeder.

FIG. 6 is a simplified side view of the paper tray 74, the wires 87, the idler pulleys 88 and the take-up pulley 89. As is obvious from FIG. 6, when rotation of the shaft 91 is driven by the pulse motor 92 and the take-up pulleys 89 are rotated clockwise, the wires 87 are reeled by the take-up pulleys 89 and the paper tray 74 moves upward. Meanwhile, when the take-up pulleys 89 are rotated anticlockwise, the wires 87 are unreeled from the take-up pulleys 89 and the paper tray 74 moves downward. Further, the rotation angle of the take-up pulleys 89, rotation of which is driven by the pulse motor 92, is associated with the height of the paper tray 74. Accordingly, the height of the paper tray 74 can be adjusted by controlling the direction and angle of rotation of the pulse motor 92.

Figure 7:
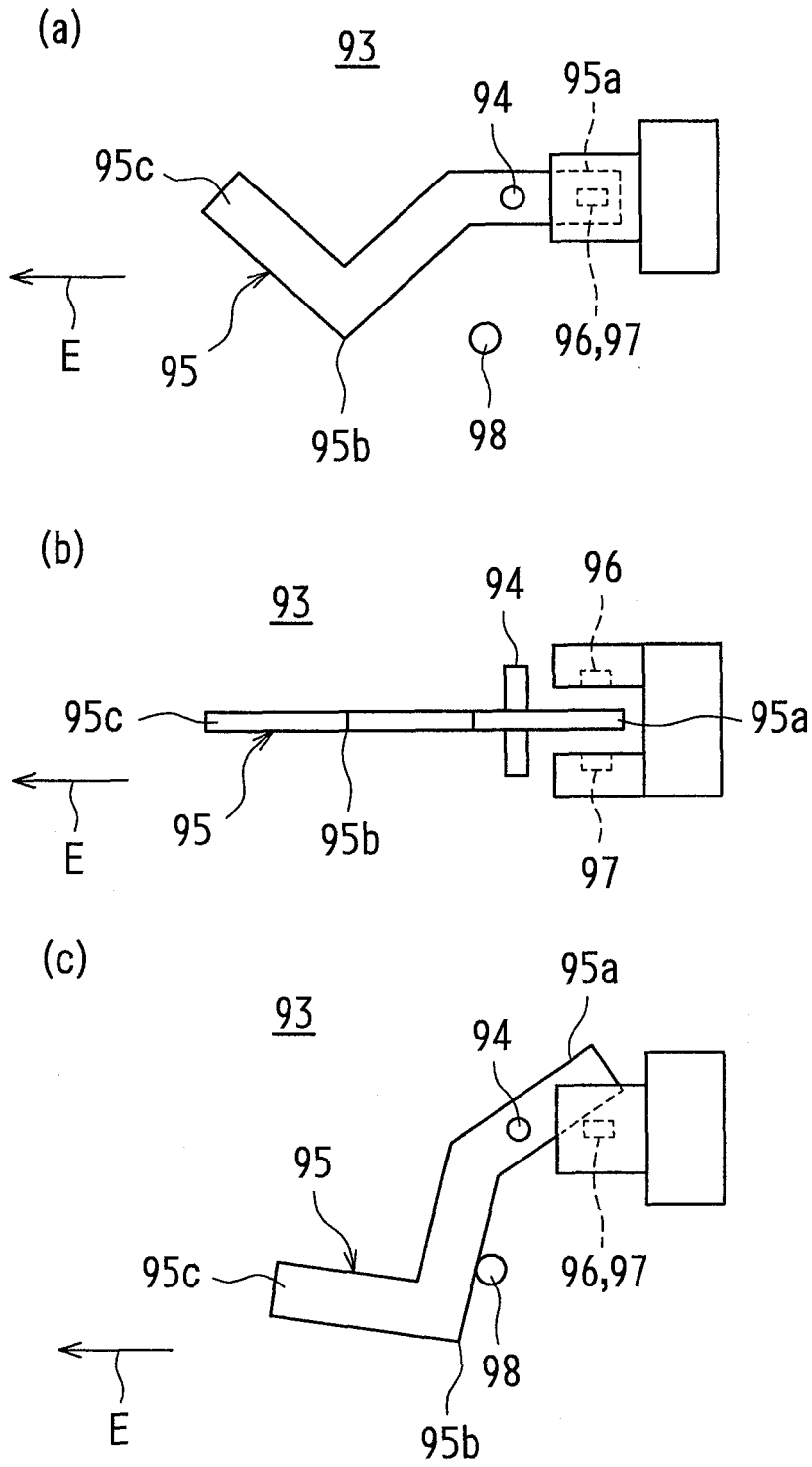
FIG. 7 includes FIGS. 7A, 7B, and 7C.

Further, as shown in FIGS. 3 and 5, the head portion 76*b* of the paper trailing edge guide 76 is provided with a height position sensor 93 for detecting the height of the uppermost paper of the bundle of papers on the paper tray 74. FIGS. 7A and 7B are simplified side view and plan view of the height position sensor 93 provided to the head portion 76*b* of the paper trailing edge guide 76. As shown in FIGS. 7A and 7B, the height position sensor 93 has an L-shaped lever 95 rotatably supported by a horizontal shaft 94, and a light-emitting element 96 and a light-receiving element 97 arranged opposite to each other with a rotational movement area of an end portion 95*a* of the L-shaped lever 95 therebetween. A leading end 95*c* of the L-shaped lever 95 faces towards the attachment plate 72*b* in the outer frame body 72, and the bending portion 95*b* in the L-shaped lever 95 protrudes downward from the head portion 76*b* of the paper trailing edge guide 76. Therefore, in the state where the bundle of papers on the paper tray 74 is held between the column 76*a* in the paper trailing edge guide 76 and the attachment plate 72*b* of the outer frame body 72, the L-shaped lever 95 is located above the back end of the bundle of papers.

Here, in the state where, as shown in FIG. 6, the take-up pulleys 89 are rotated anticlockwise by the pulse motor 92, the paper tray 74 moves downward, and the bundle of papers on the paper tray 74 is separated from the L-shaped lever 95 in the height position sensor 93, as shown in FIG. 7C, the L-shaped lever 95 rotates around the shaft 94 anticlockwise due to its own weight, the L-shaped lever 95 abuts against a stopper 98, the end 95*a* of the L-shaped lever 95 shifts out of an optical path between the light-emitting element 96 and the light-receiving element 97, and the light from the light-emitting element 96 is received by the light-receiving element 97. Further, if the take-up pulleys 89 are rotated clockwise by the pulse motor 92, the paper tray 74 moves upward, and the uppermost paper of the bundle of papers on the paper tray 74 reaches a detection reference height, as shown in FIG. 7A the uppermost paper comes into contact with the bending portion 95*b* in the L-shaped lever 95 and lifts up the bending portion 95*b*, the L-shaped lever 95 rotates clockwise around the shaft 94, the end portion 95*a* of the L-shaped lever 95 interrupts the optical path between the light-emitting element 96 and the light-receiving element 97, and the light from the light-emitting element 96 is not received by the light-receiving element 97. Moreover, if the paper tray 74 further moves upward and the uppermost paper of the bundle of papers on the paper tray 74 exceeds the detection reference height, the L-shaped lever 95 further rotates clockwise, the end portion 95*a* of the L-shaped lever 95 shifts out of the optical path between the light-emitting element 96 and the light-receiving element 97, and the light from the light-emitting element 96 is received by the light-receiving element 97.

Accordingly, whether or not the uppermost paper of the bundle of papers on the paper tray 74 is at the detection reference height can be detected based on a variation in output of the light received by the light-emitting element 97.

Figure 8:
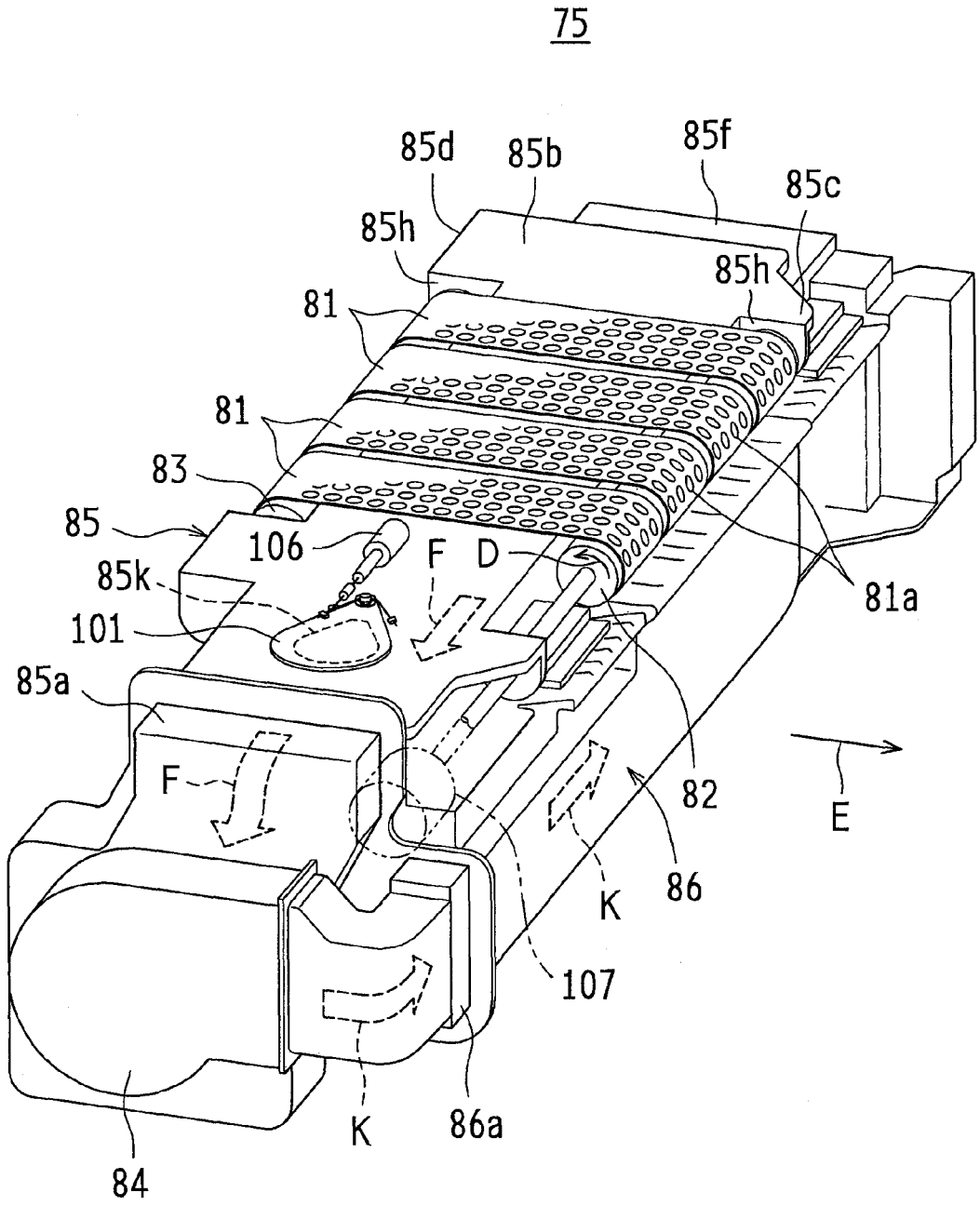
FIG. 8 is an oblique view of the paper pull-out unit viewed diagonally from the upper front.
Figure 9:
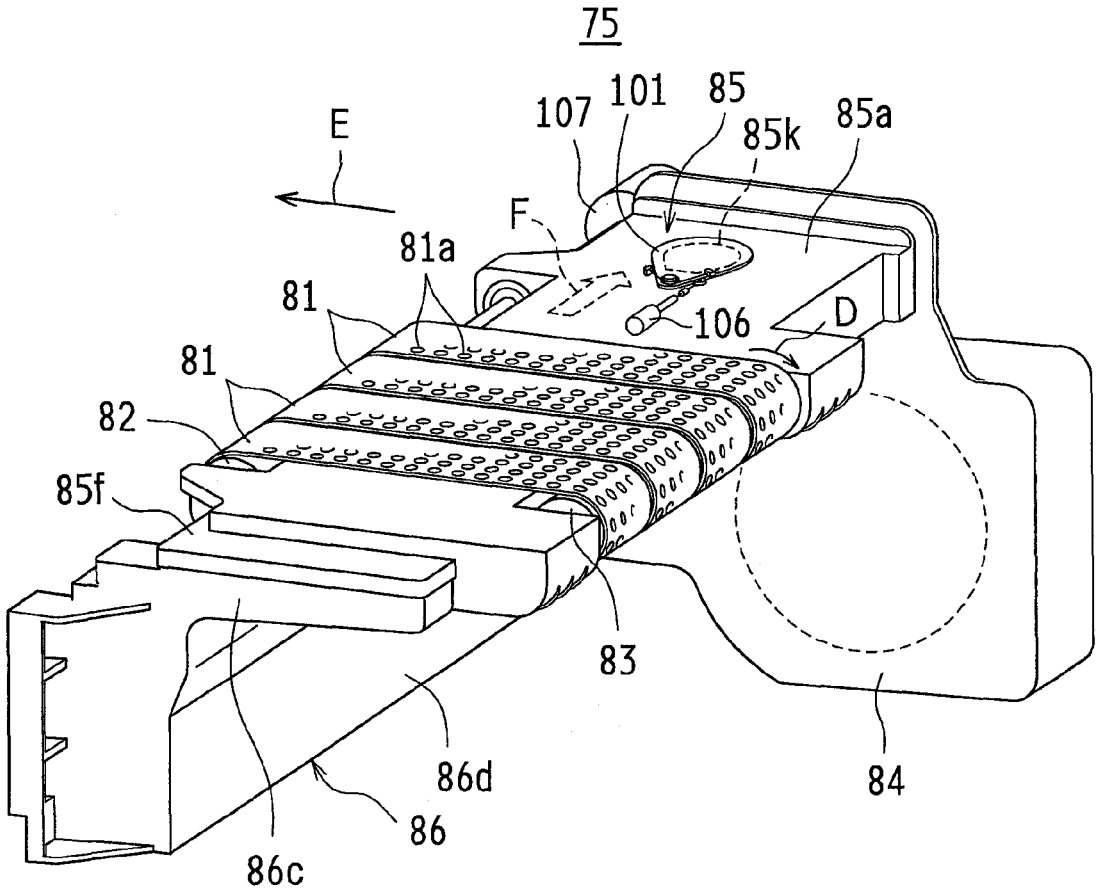
FIG. 9 is an oblique view of the paper pull-out unit viewed diagonally from the upper back.

Next, the configuration of the paper pull-out unit 75 is described in detail. FIG. 8 is an oblique view of the paper pull-out unit 75 viewed obliquely from the upper front. FIG. 9 is an oblique view of the paper pull-out unit 75 viewed obliquely from the upper back, and FIG. 10 is an oblique view of the paper pull-out unit 75 viewed obliquely from the lower back.

Figure 10:
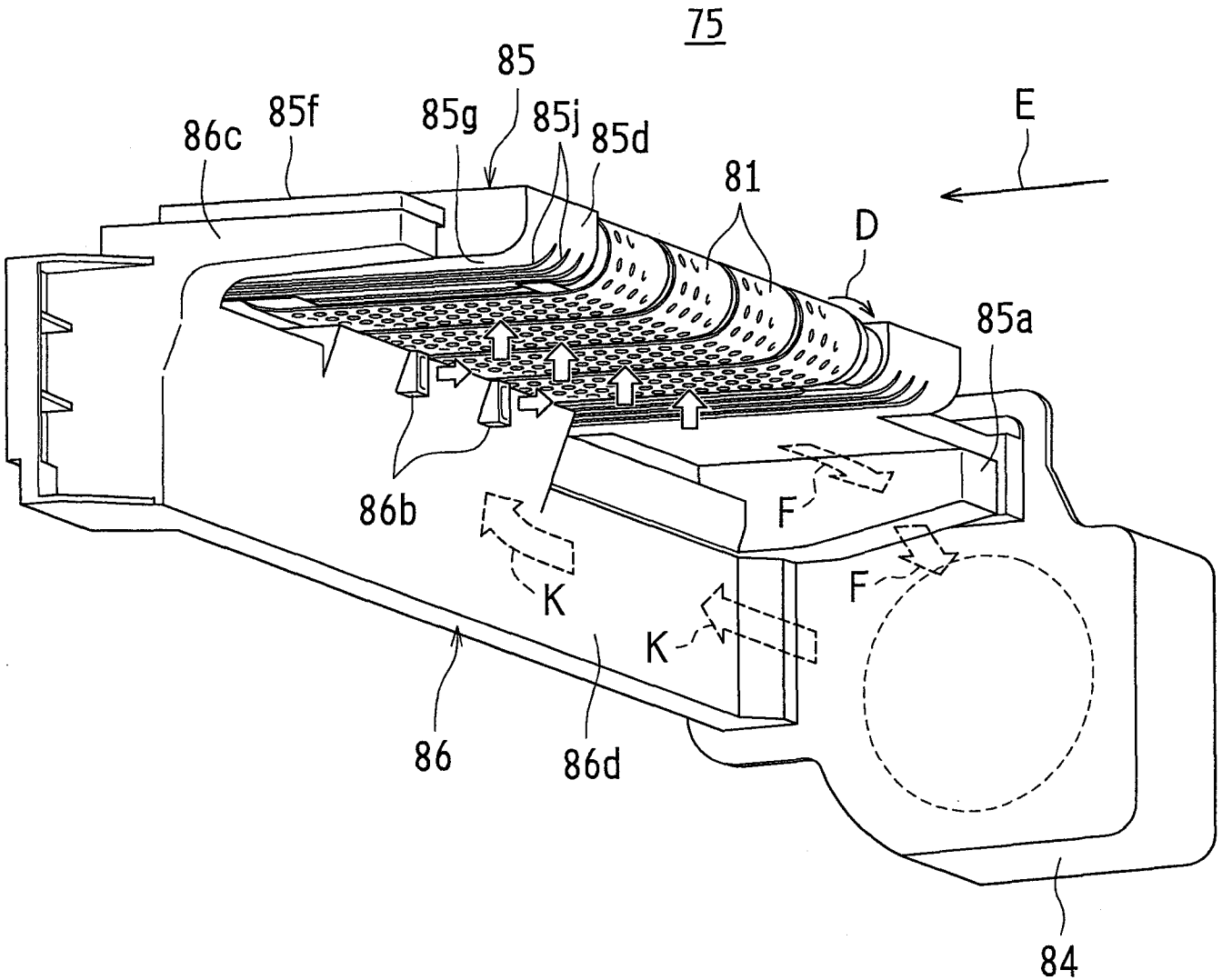
FIG. 10 is an oblique view of the paper pull-out unit viewed diagonally from the lower back.

Referring to FIGS. 8, 9, and 10, the air intake duct 85 is a hollow body, which is internally provided with a long air path extending in the direction orthogonal to the pull-out direction E. One side end 85*a* of the air path is connected to the air intake and exhaust fan 84, and as indicated by arrow F, air is breathed from the air path in the air intake duct 85 through the side end 85*a* towards an air intake port (not shown) in the air intake and exhaust fan 84.

An upper surface 85*b* of the air intake duct 85 is made flat, and a lower surface 85*g* of the air intake duct 85 is also made flat. Further, a front end 85*c* and a back end 85*d* of the air intake duct 85 are provided with recesses 85*h* respectively, where the rollers 82 and 83 are respectively arranged and supported rotatably around shafts.

The lower surface 85*g* of the air intake duct 85 is provided with a plurality of ribs 85*j* that extend in the pull-out direction E and are arranged along the direction orthogonal to the pull-out direction E. Further, as shown in the enlarged plan view of FIG. 11, a plurality of air intake holes 85*e* that communicate with the air path in the air intake duct 85 are provided between the respective ribs 85*j* on the lower surface 85*g* of the air intake duct 85.

The transport motor 107 drives rotation of the roller 82 on the front side in an arrow direction D, the roller 83 on the back side rotates following the driven rotation of the roller 82, and the paper transport belts 81 rotate in the arrow direction D. At this time, the paper transport belts 81 are in slidable contact with the ribs 85*j* provided on the lower surface 85*g* of the air intake duct 85.

Figure 11:
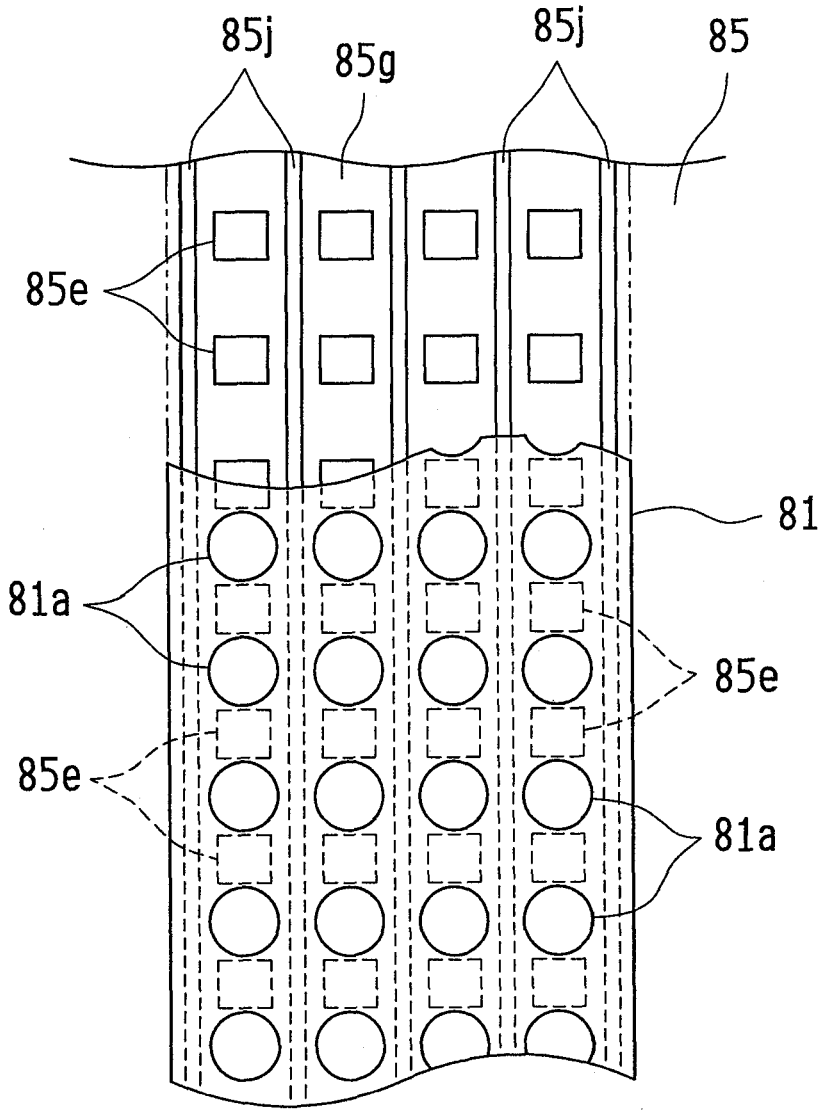
FIG. 11 is an enlarged plan view of a paper transport belt and the like in the paper pull-out unit.

Here, as shown in the enlarged plan view of FIG. 11, the air holes 81*a* on the paper transport belts 81 are arranged in multiple lines in the pull-out direction E, those lines are formed at the same interval as that of the ribs 85*j*, and the paper transport belts 81 stretch such that the lines are located between the respective ribs 85*j*. Accordingly, a space surrounded by the ribs 85*j*, the paper transport belts 81, and the lower surface 85*g* of the air intake duct 85 is formed between the respective ribs 85*j*, and in this space, the air holes 81*a* on the paper transport belts 81 and the air intake holes 85*e* on the lower surface 85*g* of the air intake duct 85 are the entrance and exit of air. Therefore, if air inside the air intake duct 85 is breathed by the air intake and exhaust fan 84, the air flows from the air holes 81*a* on the paper transport belts 81 through the space into the air intake holes 85*e* on the lower surface 85*g* of the air intake duct 85, and further flows through the air intake duct 85 towards the air intake and exhaust fan 84. Thus, recording papers can be attached to the lower surface of the paper transport belts 81.

Meanwhile, the exhaust duct 86 is also a hollow body, which is internally provided with a long air path that extends in the direction orthogonal to the pull-out direction E. One side end 86*a* of the air path is connected to the air intake and exhaust fan 84, and as indicated by arrow K, air is sent in from an exhaust port (not shown) in the air intake and exhaust fan 84 through the side end 86*a* of the exhaust duct 86 towards the air path in the exhaust duct 86.

An internal wall 86*d* of the exhaust duct 86 is provided with exhaust ports 86*b* that communicate with the air path in the exhaust duct 86. The exhaust ports 86*b* are arranged side by side in the direction orthogonal to the pull-out direction E. The internal wall 86*d* of the exhaust duct 86 is arranged to cover the outer surface of the attachment plate 72*b* (shown in FIG. 5) in the outer frame body 72, and the exhaust ports 86*b* in the exhaust duct 86 face towards the inside of the outer frame body 72 through a cutout portion 72*c* in the attachment plate 72*b* in the outer frame body 72. If air is sent in from the air intake and exhaust fan 84 towards the exhaust duct 86, this air is blown backward from the exhaust ports 86*b* towards the inside of the outer frame body 72.

Further, both the side end 85*a* of the air intake duct 85 and the side end 86*a* of the exhaust duct 86 are connected to the air intake and exhaust fan 84, and the other side end 85*f* of the air intake duct 85 and the other side end 86*c* of the exhaust duct 86 are connected to each other, and thus the air intake and exhaust fan 84, the air intake duct 85, and the exhaust duct 86 are integrated.

In the above-described paper feeder 71, it is assumed that, as shown in the side view of FIG. 2, a bundle of papers is loaded on the paper tray 74, the leading end and the back end of the bundle of papers are held between the column 76*a* in the paper trailing edge guide 76 and the attachment plate 72*b* in the outer frame body 72 and thus positioned, and the both sides of the bundle of papers are held between the assist ducts 77 and 78 and thus positioned. Then, the take-up pulleys 89 are rotated clockwise by the pulse motor 92 to move the paper tray 74 upward, and if the uppermost paper of the bundle of papers on the paper tray 74 is detected by the height position sensor 93, that is, if the uppermost paper reaches the detection reference height, the pulse motor 92 is stopped and the uppermost paper is positioned at the detection reference height. Further, air is sent in from the assist fans 79 and 80 towards the assist ducts 77 and 78 and blown from the exhaust ports 77*a* and 78*a* in the assist ducts 77 and 78 against the both sides of the upper layer near the leading end of the bundle of papers loaded on the paper tray 74, such that the air gets in between the respective recording papers and those papers separate from one another. Further, air is sent from the air intake and exhaust fan 84 towards the exhaust duct 86 and blown from the exhaust ports 86*b* in the exhaust duct 86 against the leading end of the upper layer of the bundle of papers such that air gets in (i.e., air is caused to flow) between the respective recording papers and those papers separate from one another. Thus, the adhesion (force generated due to stacking, or the like) between the recording papers in the upper layer of the bundle of papers is lowered, and it becomes easier to pull out recording papers from the bundle of papers and to pull out recording papers one by one.

In this state, when air is breathed from the air intake duct 85 towards the air intake and exhaust fan 84, the rollers 82 and 83 are intermittently rotated and the paper transport belts 81 are intermittently rotated while taking the air in through the air holes 81*a* on the paper transport belts 81 and the air intake holes 85*e* on the lower surface 85*g* of the air intake duct 85, a recording paper is attached to the lower surface of the paper transport belts 81, pulled out by the paper transport belts 81 in the pull-out direction E, transported to the transport roller pair 31, and then transported through the transport path 33. Subsequently, the next recording paper is attached to the lower surface of the paper transport belts 81, pulled out by the paper transport belts 81 in the pull-out direction E, and transported to the transport roller pair 31. After that, similarly, recording papers are attached to the lower surface of the paper transport belts 81, and pulled out and transported by the paper transport belts 81 in the pull-out direction E.

Incidentally, the paper feeder 71 has a configuration where, with the single air intake and exhaust fan 84, air is breathed from the air holes 81*a* on the paper transport belt 81 through the air intake duct 85, as well as blown through the exhaust duct 86 against the sides of the bundle of papers on the paper tray 74. Accordingly, the amount of air breathed by the air intake and exhaust fan 84 and the amount of air exhausted thereby are approximately the same, and if one of those air amounts reduces, the other also reduces. Therefore, when a sheet of paper is attached to the paper transport belts 81, if the air holes 81*a* on the paper transport belts 81 are blocked and the amount of the air breathed towards the air intake duct 85 reduces, the amount of the air blown from the exhaust ports 86*b* in the exhaust duct 86 against the sides of the bundle of papers on the paper tray 74 accordingly reduces. If such a phenomenon where the amount of the air breathed and exhausted reduces is left as it is, air is not caused to flow into the recording papers in the upper layer of the bundle of papers on the paper tray 74 and the adhesion between the recording papers is not lowered, and a transportation error occurs where a plurality of recording papers are simultaneously pulled out.

Therefore, in the present embodiment, an air pressure sensor for detecting the air pressure in the air intake duct 85 in the paper pull-out unit 75 is provided. Further, as shown in FIGS. 3, 8, and so on, an opening 85*k* is formed on the wall on the upper surface 85*b* side of the air intake duct 85, and an opening and closing body 101 for opening and closing the opening 85*k* is provided.

Here, if the air holes 81*a* on the paper transport belts 81 are blocked and the amount of the air breathed towards the air intake duct 85 reduces, the air pressure in the air intake duct 85 is lowered, and so whether or not the amount of the air breathed towards the air intake duct 85 has reduced can be determined based on the air pressure detected by the air pressure sensor. Then, if it is determined that the amount of the air breathed towards the air intake duct 85 has reduced, the opening and closing body 101 is moved to open the opening 85*k* on the upper surface 85*b* side of the air intake duct 85, thereby letting air flow through the opening 85*k* into the air intake duct 85, and with the air thus caused to flow, the amount of the air breathed and exhausted by the air intake and exhaust fan 84 can be increased. As a result, the reduced air amount is restored, the amount of the air blown from the exhaust ports 86*b* in the exhaust duct 86 against the sides of the bundle of papers on the paper tray 74 is also restored, air is blown between the respective recording papers, thereby reducing the adhesion between the recording papers, and thus the transportation error where a plurality of recording papers are simultaneously pulled out is prevented.

Figure 12:
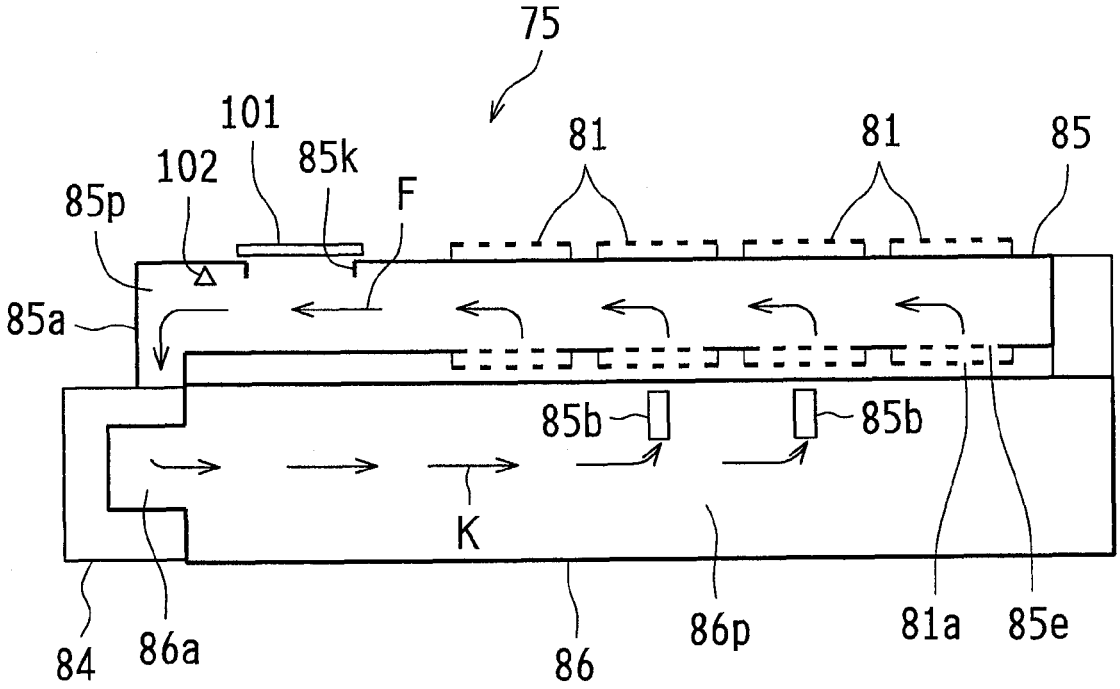
FIG. 12 is a schematic front view of the paper pull-out unit.

Next, the control system of the air pressure sensor, the opening and closing body 101, and the paper feeder 71 is described in detail. FIG. 12 is a schematic front view of the paper pull-out unit 75 in the paper feeder 71. As shown in FIG. 12, both the side end 85*a* of the air intake duct 85 and the side end 86*a* of the exhaust duct 86 are connected to the air intake and exhaust fan 84, thereby letting the air intake duct 85 communicate with the inside of the paper transport belts 81.

In an air path 85*p* in the air intake duct 85, air that flows in through the air holes 81*a* on the paper transport belts 81 and the air intake holes 85*e* on the air intake duct 85 flows in the direction indicated by arrow F and is breathed towards the air intake and exhaust fan 84. The opening 85*k* is formed downstream of the paper transport belts 81 in the direction of arrow F, and the opening and closing body 101 for opening and closing the opening 85*k* is provided. Further, the air pressure sensor 102 is arranged downstream of the opening 85*k* in the direction of arrow F in which the air flows and near the opening 85*k*, and this air pressure sensor 102 is secured on the inner wall of the air intake duct 85. With the position of the air pressure sensor 102, variations in the air pressure in the air intake duct 85 when the air holes 81*a* on the paper transport belts 81 are blocked and when the opening 85*k* is opened and air flows in through the opening 85*k* can be detected in the fastest manner and with accuracy.

Further, in the air path 86*p* in the exhaust duct 86, air exhausted from the air intake and exhaust fan 84 flows in the direction of arrow K and is brown out from the exhaust ports 86*b*.

Figure 13A:
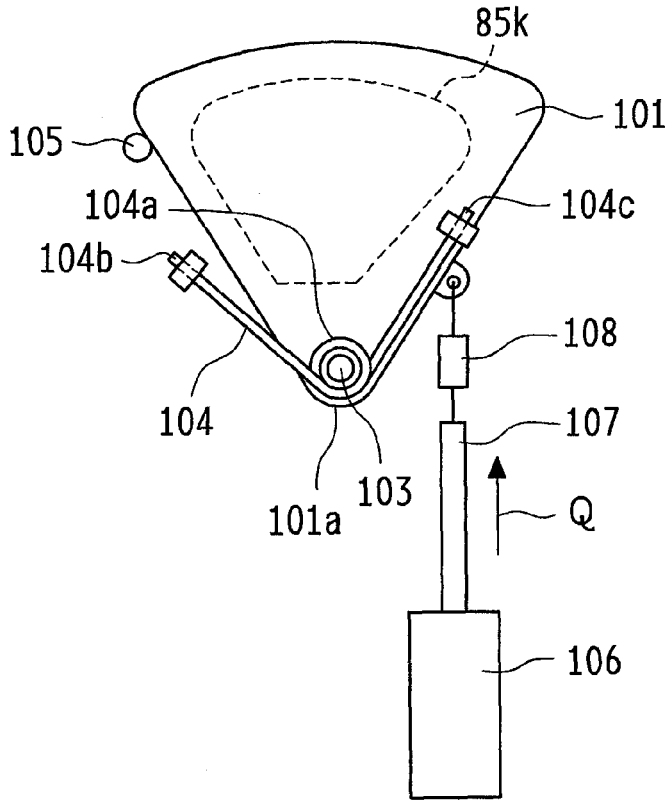
FIGS. 13A and 13B are schematic front views of an opening and an opening and closing body in an air intake duct.
Figure 13B:
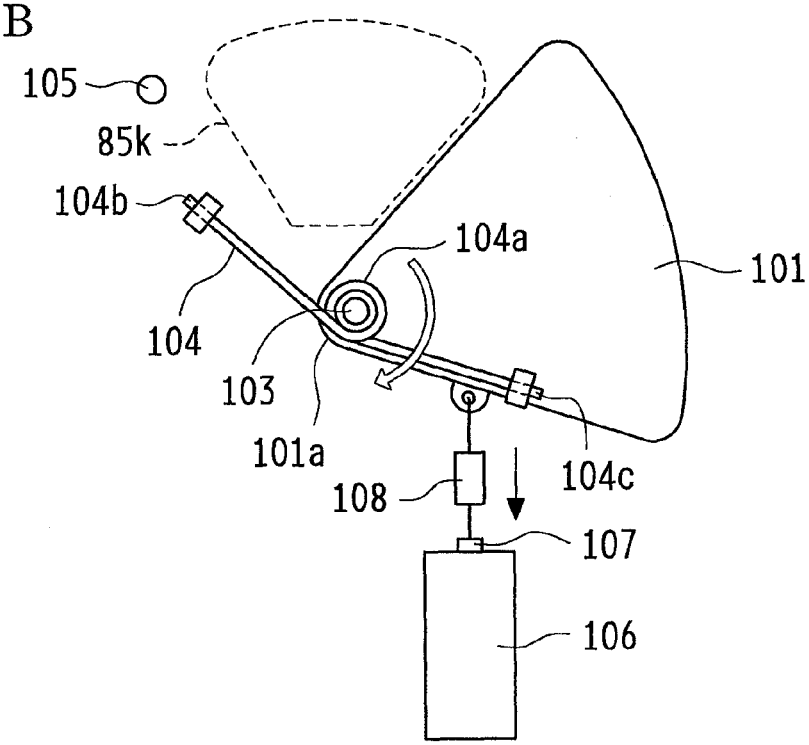

FIGS. 13A and 13B are schematic plan views of the opening 85*k* and the opening and closing body 101 in the air intake duct 85. The opening 85*k* in the air intake duct 85 is formed in an approximately triangle shape, and the opening and closing body 101 is also formed in an approximately triangle shape in accordance with the shape of the opening 85*k*.

The opening and closing body 101 is rotatably supported by a shaft 103 caused to pass through a hole in a corner 101*a* of the opening and closing body 101. Further, the shaft 103 is caused to pass through a ring 104*a* formed at the center of an L-shaped kick spring 104, an end 104*b* of the kick spring 104 is secured on the external wall of the air intake duct 85, the other end 104*c* of the kick spring 104 is secured to the opening and closing body 101, and the opening and closing body 101 is biased anticlockwise by the kick spring 104. Further, a solenoid 106 is secured on the external wall of the air intake duct 85, and a plunger 107 in the solenoid 106 communicates with the opening and closing body 101 via a dumper 108.

If the solenoid 106 is de-energized, as shown in FIG. 13A the plunger 107 protrudes in the direction of arrow Q, the opening and closing body 101 is moved by the kick spring 104 to rotate anticlockwise until the opening and closing body 101 abuts against a stopper 105, and the opening 85*k* in the air intake duct 85 is closed by the opening and closing body 101.

Meanwhile, if the solenoid 106 is energized, as shown in FIG. 13B the plunger 107 draws back in a direction opposite arrow Q, the opening and closing body 101 is moved to rotate clockwise against the elastic force of the kick spring 104, and the opening 85*k* in the air intake duct 85 is opened.

Accordingly, the opening 85*k* can be closed or opened by de-energizing or energizing the solenoid 106.

Figure 14:
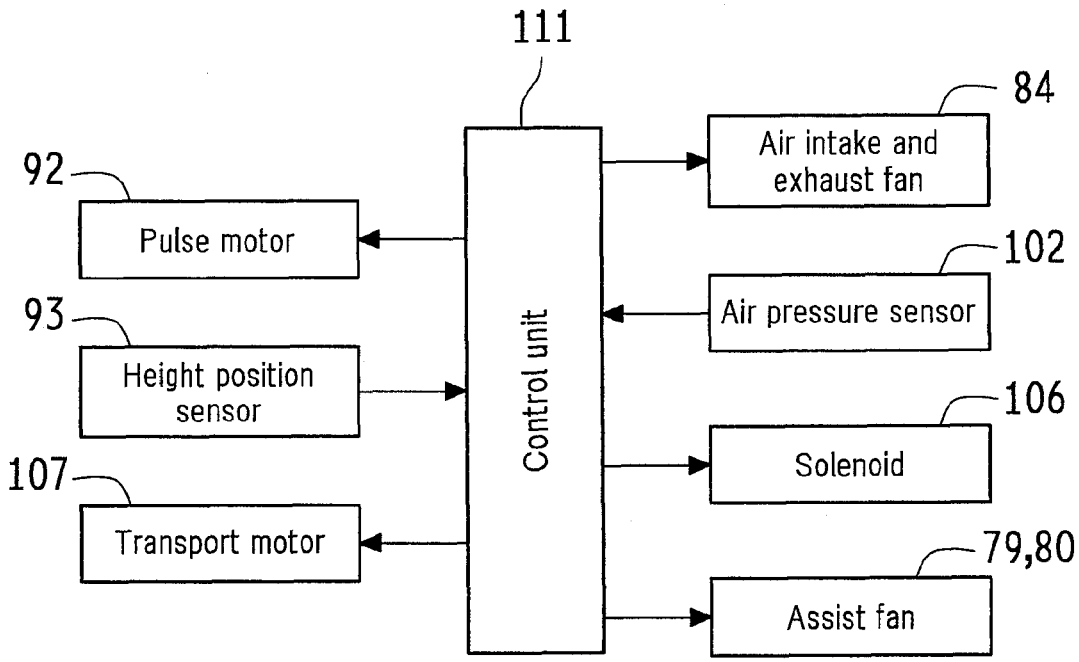
FIG. 14 is a block diagram showing a configuration of a control system of the paper feeder.

FIG. 14 is a block diagram showing a configuration of the control system of the paper feeder 71. Referring to FIG. 14, the control unit 111 is designed to control the paper feeder 71 and the like in an integrated manner, and includes a CPU, a RAM, a ROM, various interfaces, and the like. For example, the control unit 111 controls the pulse motor 92 based on the height of the uppermost paper of a bundle of papers on the paper tray 74 detected by the height position sensor 93 to adjust the height of the uppermost paper of the bundle of papers, and de-energizes or energizes the solenoid 106 based on the air pressure in the air intake duct 85 detected by the air pressure sensor 102 to rotate the opening and closing body 101 and open or close the opening 85*k*.

Next, the control of the paper feeder 71 by the control unit 111 is described in detail. First, the control unit 111 controls driving of the pulse motor 92, rotates the take-up pulleys 89, and moves up the paper tray 74. Then, if the height position sensor 93 detects that the uppermost paper of a bundle of papers on the paper tray 74 reaches the detection reference height, the control unit 111 stops the pulse motor 92 to stop moving up the paper tray 74, and positions the uppermost paper of the bundle of papers on the paper tray 74 at the detection reference height. At this time, as shown in FIG. 2, a clearance h0 between the uppermost paper of the bundle of papers on the paper tray 74 and the lower surface of the paper transport belts 81 is a predetermined distance ha.

Further, the control unit 111 drives the assist fans 79 and 80 to cause air to blow from the exhaust ports 77*a* and 78*a* in the assist ducts 77 and 78 against the both sides in the upper layer near the leading end of the bundle of papers on the paper tray 74. Further, the control unit 111 drives the air intake and exhaust fan 84 to cause air to blow through the exhaust duct 86 from the exhaust ports 86*b* in the exhaust duct 86 against the both sides in the upper layer of the bundle of papers on the paper tray 74, and to breath air through the air holes 81*a* on the paper transport belts 81 and the air intake holes 85*e* on the lower surface 85*g* of the air intake duct 85 towards the air intake duct 85. Thus, the adhesion between the papers in the upper layer of the bundle of papers is lowered, and the recording papers are attached to the lower surface of the paper transport belts 81.

Then, the control unit 111 controls driving of the transport motor 107 to intermittently rotate the rollers 82 and 83 and intermittently rotate the paper transport belts 81. Thus, the recording papers are attached to the lower surface of the paper transport belts 81, pulled out by the paper transport belts 81, and transported to the transport path 33 in the image forming apparatus 1. Such pulling out and transportation of recording papers are repeated.

After the recording papers are thus sequentially pulled out from the bundle of papers on the paper tray 74 and transported, the height of the uppermost paper of the bundle of papers on the paper tray 74 is lowered, and the height position sensor 93 detects that the uppermost paper of the bundle of papers on the paper tray 74 has become lower than the detection reference height (h0>ha). In response thereto, the control unit 111 controls driving of the pulse motor 92 to move up the paper tray 74 again until the height position sensor 93 detects that the uppermost paper of the bundle of papers on the paper tray 74 is at the detection reference height, and resets the clearance h0 between the uppermost paper of the bundle of papers on the paper tray 74 and the lower surface of the paper transport belts 81 to the predetermined distance ha.

After that, similarly, the recording papers are sequentially pulled out from the bundle of papers on the paper tray 74 and transported, and if the uppermost paper of the bundle of papers on the paper tray 74 becomes lower than the detection reference height (h0>ha), the paper tray 74 is moved up, the uppermost paper of the bundle of papers on the paper tray 74 is positioned at the predetermined height, and the clearance h0 is set to the predetermined distance ha.

Accordingly, the clearance h0 is substantially kept at the predetermined distance ha. This predetermined distance ha is a distance suitable for causing the recording papers to be attached to the lower surface of the paper transport belts 81, and the recording papers on the paper tray 74 can be quickly breathed and pulled out one by one by the paper transport belts 81.

Furthermore, while the paper feeder 71 is operating, the control unit 111 monitors the air pressure in the air intake duct 85 detected by the air pressure sensor 102 and compares the detected air pressure in the air intake duct 85 with a predetermined threshold. If the detected air pressure in the air intake duct 85 is kept at or higher than the threshold, the control unit 111 keeps de-energizing the solenoid 106 and closing the opening 85*k* in the air intake duct 85. Meanwhile, if the detected air pressure in the air intake duct 85 becomes lower than the threshold, the control unit 111 energizes the solenoid 106 to open the opening 85*k* in the air intake duct 85 and cause air to flow through the opening 85*k* into the air intake duct 85. Simultaneously, the control unit 111 controls driving of the air intake and exhaust fan 84 to accelerate its rotational speed and increase the amount of air breathed and exhausted by the air intake and exhaust fan 84. Thus, the amount of air caused to flow through the opening 85*k* into the air intake duct 85 is promptly increased, and the air pressure in the air intake duct 85 is promptly increased.

Then, after the air pressure in the air intake duct 85 detected by the air pressure sensor 102 is restored to the threshold or higher, the control unit 111 de-energizes the solenoid 106 to close the opening 85*k* in the air intake duct 85, and also decelerates the rotational speed of the air intake and exhaust fan 84 to the normal speed.

Here, if the paper transport belts 81 are intermittently rotated and the recording papers are attached one by one to the lower surface of the paper transport belts 81 and pulled out, the air holes 81*a* on the paper transport belts 81 are blocked due to attachment of the recording papers, and in some cases the amount of air breathed towards the air intake duct 85 is reduced, and the amount of air blown from the exhaust ports 86*b* in the exhaust duct 86 is accordingly reduced.

In this case, the air pressure in the air intake duct 85 detected by the air pressure sensor 102 becomes lower than the threshold. Therefore the solenoid 106 is energized to open the opening 85*k* in the air intake duct 85, the rotational speed of the air intake and exhaust fan 84 is accelerated, and air is promptly caused to flow through the opening 85*k* into the air intake duct 85. Thus, the amount of air breathed and exhausted by the air intake and exhaust fan 84 is increased and restored, the amount of air blown from the exhaust ports 86*b* in the exhaust duct 86 against the sides of the bundle of papers on the paper tray 74 is also restored, the air is caused to flow into the respective recording papers, the adhesion between the recording papers is reduced, and the transportation error where a plurality of recording papers are simultaneously pulled out is thus prevented.

Then, after the air pressure in the air intake duct 85 is restored to the threshold or higher due to the air flow from the opening 85*k*, the solenoid 106 is de-energized to close the opening 85*k* in the air intake duct 85 again, and the rotational speed of the air intake and exhaust fan 84 is returned to the normal speed. Thus, the amount of air breathed from the air holes 81*a* on the paper transport belts 81 through the air intake duct 85 towards the air intake and exhaust fan 84 is restored, and the attaching force of the recording papers to the lower surface of the paper transport belts 81 is restored.

Subsequently, the same operation is repeated, thereby keeping the air pressure in the air intake duct 85 approximately at or higher than the threshold and preventing the air pressure in the air intake duct 85 from becoming much lower than the threshold.

Therefore, the amount of air sent from the air intake and exhaust fan 84 to the exhaust duct 86 is always sufficient, the air can be blown from the exhaust ports 86*b* in the exhaust duct 86 against the upper layer of the bundle of papers on the paper tray 74, and thus the transportation error where a plurality of recording papers are simultaneously pulled out does not occur. Further, the recording papers can be continuously attached to the lower surface of the paper transport belts 81.

As described above, the paper feeder 71 in the present embodiment is provided with the air pressure sensor 102 for detecting the air pressure in the air intake duct 85, as well as provided with the opening 85*k* on the wall of the air intake duct 85 and the opening and closing body 101 for opening and closing the opening 85*k*. If the air pressure in the air intake duct 85 detected by the air pressure sensor 102 becomes lower than the threshold, the solenoid 106 is energized to open the opening 85*k* in the air intake duct 85 and accelerate the rotational speed of the air intake and exhaust fan 84, and air is promptly caused to flow through the opening 85*k* into the air intake duct 85. Meanwhile, after the air pressure in the air intake duct 85 detected by the air pressure sensor 102 is restored to the threshold or higher, the solenoid 106 is de-energized to close the opening 85*k* in the air intake duct 85 and restore the rotational speed of the air intake and exhaust fan 84 to the normal speed. Therefore, a transportation error can be prevented by causing air to blow from the air holes 81*a* on the exhaust duct 86 against the upper layer of the bundle of papers on the paper tray 74, and the recording papers can be continuously attached to the lower surface of the paper transport belts 81.

In the above-described embodiment, the opening 85*k* in the air intake duct 85 is closed when the air pressure in the air intake duct 85 detected by the air pressure sensor 102 is restored to the threshold or higher. However, the elapsed time from when the opening 85*k* in the air intake duct 85 is opened may be measured, and the opening 85*k* in the air intake duct 85 may be closed when this elapsed time reaches a predetermined time. Alternatively, the opening 85*k* in the air intake duct 85 may be closed when the air pressure in the air intake duct 85 detected by the air pressure sensor 102 is restored to the threshold or higher or when the elapsed time reaches the predetermined time. This is for the purpose of preventing the attaching force of the recording papers to the paper transport belts 81 from being significantly lowered by limiting the period of time to open the opening 85*k* to a short period of time because, in the state where the opening 85*k* in the air intake duct 85 is open, air flows from the opening 85*k* towards the air intake and exhaust fan 84, the amount of air breathed from the air holes 81*a* on the paper transport belts 81 decreases, and the attaching force of the recording papers to the paper transport belts 81 is lowered.

Furthermore, the air pressure in the air intake duct 85 is detected by the air pressure sensor 102, but alternatively, the air flow rate in the air intake duct 85 may be detected by a flow sensor. If the air holes 81*a* on the paper transport belts 81 are blocked due to the attachment of the recording papers, the amount of air breathed towards the air intake duct 85 is reduced and the air flow rate detected by the flow sensor is also reduced. Therefore, the opening 85*k* is opened when the air flow rate detected by the flow sensor becomes lower than a predetermined threshold, thus air is caused to flow through the opening 85*k* into the air intake duct 85, and the opening 85*k* is closed after the air flow rate detected by the flow sensor is increased and restored to the threshold or higher.

The preferable embodiment of the present invention has been described with reference to the accompanying drawings, but needless to say the present invention is not limited the above-described examples. It is obvious that a person skilled in the art would arrive at various modified or revised examples within the scope stated in the claims, and it is understood that those modified or revised examples also naturally belong to the technical scope of the present invention.

What is claimed is:

1. A paper feeder, wherein an air hole that allows air to pass through is formed on a paper transport belt for transporting a sheet of paper, a fan for breathing and exhausting air and an exhaust duct forming an opening for exhausting air are connected to each other, air is exhausted from the fan through the exhaust duct, the fan and an air intake duct for breathing air are connected to each other, air is breathed from the air hole through the air intake duct towards the fan, and a sheet of paper is transported by the paper transport belt by causing the paper to be attached to the paper transport belt, and the paper feeder comprising:

an air state detection unit for detecting at least one of an air pressure and an air flow rate in the air intake duct;

an opening and closing unit for opening and closing an opening formed in the air intake duct; and a control unit for opening and closing the opening formed in the air intake duct based on a result of detection by the air state detection unit, wherein if either one of the air pressure and the air flow rate in the air intake duct detected by the air state detection unit becomes lower than a predetermined threshold, the control unit controls the opening and closing unit to open the opening, and if either one of the air pressure and the air flow rate in the air intake duct becomes equal to or higher than the predetermined threshold, the control unit controls the opening and closing unit to close the opening.

2. The paper feeder according to claim 1, wherein the air state detection unit is provided downstream of the opening in the air intake duct in a direction of air flow in the air intake duct.

3. An image forming apparatus comprising the paper feeder according to claim 1.

4. A paper feeder, wherein an air hole that allows air to pass through is formed on a paper transport belt for transporting a sheet of paper, a fan for breathing and exhausting air and an exhaust duct forming an opening for exhausting air are connected to each other, air is exhausted from the fan through the exhaust duct, the fan and an air intake duct for breathing air are connected to each other, air is breathed from the air hole through the air intake duct towards the fan, and a sheet of paper is transported by the paper transport belt by causing the paper to be attached to the paper transport belt, and the paper feeder comprising:

an air state detection unit for detecting at least one of an air pressure and an air flow rate in the air intake duct;

an opening and closing unit for opening and closing an opening formed in the air intake duct; and a control unit for opening and closing the opening formed in the air intake duct based on a result of detection by the air state detection unit, wherein if either one of the air pressure and the air flow rate in the air intake duct detected by the air state detection unit becomes lower than a predetermined threshold, the control unit controls the opening and closing unit to open the opening, and when a predetermined time elapses from a time the opening is opened, the control unit controls the opening and closing unit to close the opening.

5. The paper feeder according to claim 4, wherein the air state detection unit is provided downstream of the opening in the air intake duct in a direction of air flow in the air intake duct.

6. An image forming apparatus comprising the paper feeder according to claim 4.

7. A paper feeder, wherein an air hole that allows air to pass through is formed on a paper transport belt for transporting a sheet of paper, a fan for breathing and exhausting air and an exhaust duct forming an opening for exhausting air are connected to each other, air is exhausted from the fan through the exhaust duct, the fan and an air intake duct for breathing air are connected to each other, air is breathed from the air hole through the air intake duct towards the fan, and a sheet of paper is transported by the paper transport belt by causing the paper to be attached to the paper transport belt, and the paper feeder comprising:

an air state detection unit for detecting at least one of an air pressure and an air flow rate in the air intake duct;

an opening and closing unit for opening and closing an opening formed in the air intake duct; and a control unit for opening and closing the opening formed in the air intake duct based on a result of detection by the air state detection unit, wherein when the control unit controls the opening and closing unit to open the opening, the control unit controls the fan to accelerate a rotational speed of the fan.

8. The paper feeder according to claim 7, wherein the air state detection unit is provided downstream of the opening in the air intake duct in a direction of air flow in the air intake duct.

9. An image forming apparatus comprising the paper feeder according to claim 7.

* * * * *